US012408739B2

(12) United States Patent
Pao

(10) Patent No.: US 12,408,739 B2
(45) Date of Patent: Sep. 9, 2025

(54) FOLDING CRUTCH CHAIR WITH A COMPACT SUPPORT DEVICE

(71) Applicant: STEP2GOLD CO., LTD., Taichung (TW)

(72) Inventor: Chih-Ting Pao, Taichung (TW)

(73) Assignee: STEP2GOLD CO., LTD., Taichung (TW)

( * ) Notice: Subject to any disclaimer, the term of this patent is extended or adjusted under 35 U.S.C. 154(b) by 196 days.

(21) Appl. No.: 18/345,356

(22) Filed: Jun. 30, 2023

(65) Prior Publication Data

US 2024/0008606 A1 Jan. 11, 2024

(30) Foreign Application Priority Data

Jul. 8, 2022 (TW) ..... 111125756

(51) Int. Cl.
*A45B 5/00* (2006.01)
*A47C 4/14* (2006.01)
(Continued)

(52) U.S. Cl.
CPC ..... *A45B 5/00* (2013.01); *A47C 4/14* (2013.01); *A47C 4/16* (2013.01); *A47C 4/20* (2013.01);
(Continued)

(58) Field of Classification Search
CPC ..... A45B 5/00; A45B 9/00; A45B 2009/007; A47C 4/14; A47C 4/16; A47C 4/20;
(Continued)

(56) References Cited

U.S. PATENT DOCUMENTS 5,975,626 A * 11/1999 Aycock ..... A47C 9/105 297/16.2
D1,049,668 S * 11/2024 You ..... D6/353
(Continued)

FOREIGN PATENT DOCUMENTS

CN 216220475 U 4/2022
TW 201247133 A1 12/2012
(Continued)

OTHER PUBLICATIONS

Search Report appended to an Office Action, which was issued to Taiwanese counterpart application No. 111125756 by the TIPO on Aug. 9, 2023, with an English translation thereof.

*Primary Examiner* — Robert Canfield
(74) *Attorney, Agent, or Firm* — Burris Law, PLLC

(57) ABSTRACT

A folding crutch chair includes a pivot base unit and at least three support leg units. The pivot base unit has at least three mounting slots angularly spaced apart from one another about an axial line, and at least three pairs of joint portions respectively formed in the mounting slots. Each support leg unit includes a pivot seat, an outer tubular piece, and an inner tubular piece extending telescopically relative to the outer tubular piece. The pivot seat has a pair of pivot portions respectively and pivotably connected with the joint portions such that each support leg unit is rotatable relative to the pivot base unit. The support leg units are shiftable between a folded state and an unfolded state. The length of the support leg units is reduced when folded so as to facilitate packaging, storage and carrying.

10 Claims, 13 Drawing Sheets

(51) Int. Cl.

| | |
|---|---|
| ***A47C 4/16*** | (2006.01) |
| ***A47C 4/20*** | (2006.01) |
| ***A47C 4/22*** | (2006.01) |
| ***A47C 4/24*** | (2006.01) |
| ***A47C 4/26*** | (2006.01) |
| ***A47C 9/00*** | (2006.01) |
| ***A47C 9/10*** | (2006.01) |

(52) U.S. Cl.
CPC ..... *A47C 4/22* (2013.01); *A47C 4/24* (2013.01); *A47C 4/26* (2013.01); *A47C 9/10* (2013.01); *A47C 9/105* (2013.01)

(58) Field of Classification Search
CPC .... A47C 4/22; A47C 4/24; A47C 4/26; A47C 9/10; A47C 9/105
See application file for complete search history.

(56) References Cited

U.S. PATENT DOCUMENTS

| | | | | |
|---|---|---|---|---|
| 2015/0196103 | A1* | 7/2015 | Pao | A47C 9/105 297/55 |
| 2015/0265012 | A1* | 9/2015 | Pao | A45B 5/00 135/66 |
| 2022/0061535 | A1* | 3/2022 | Pao | A45B 5/00 |
| 2022/0240682 | A1* | 8/2022 | Pao | A45B 5/00 |
| 2024/0008605 | A1* | 1/2024 | Pao | A45B 5/00 |
| 2024/0041217 | A1* | 2/2024 | Pao | A47C 9/105 |

FOREIGN PATENT DOCUMENTS

| | | |
|---|---|---|
| TW | I730881 B | 6/2021 |
| TW | M613818 | 7/2021 |

* cited by examiner

FOLDING CRUTCH CHAIR WITH A COMPACT SUPPORT DEVICE

CROSS-REFERENCE TO RELATED APPLICATION

This application claims priority to Taiwanese Patent Application No. 111125756, filed on Jul. 8, 2022.

FIELD

The disclosure relates to a folding crutch chair, and more particularly to a folding crutch chair with a compact support device.

BACKGROUND

A conventional folding crutch chair as disclosed in Taiwanese Patent No. TWM613818 includes a primary leg unit, a seating unit and a support unit. The seating unit and the support unit are pivotably connected with the primary leg unit at two sides, respectively. The primary leg unit has a primary leg frame defining an elongated slot, and a sliding rod slidably disposed at an upper end of the primary leg frame. The seating unit has a seating plate pivotably connected with the primary leg frame, and a sliding bracket slidably disposed on the sliding rod. The support unit has a first leg and a second leg which are turnable to be close to each other, and to be received together in the elongated slot so as to shift the folding crutch chair into a crutch or a chair.

However, the size of the folding crutch chair is bulky because the length of the primary leg unit and the support unit can not be reduced, which is inconvenient for package, carry and storage.

SUMMARY

Therefore, an object of the disclosure is to provide a folding crutch chair that can alleviate at least one of the drawbacks of the prior art.

According to the disclosure, the folding crutch chair includes a pivot base unit and at least three support leg units. The pivot base unit has at least three mounting slots which are angularly spaced apart from one another about an axial line, and at least three pairs of joint portions which are respectively formed in the mounting slots. Each of the support leg units includes a pivot seat which extends through a respective one of the mounting slots and which is pivotably connected with the pivot base unit, an outer tubular piece which is securely disposed on the pivot seat and which extends along a longitudinal direction, an inner tubular piece which extends telescopically relative to the outer tubular piece along the longitudinal direction and which has a lower end portion, and a retaining assembly which is connected between the outer tubular piece and the inner tubular piece to retain the inner tubular piece to the outer tubular piece when the inner tubular piece is extended from the outer tubular piece. The pivot seat of each support leg unit has a pair of pivot portions which are respectively and pivotably connected with the joint portions of a corresponding pair of the pivot base unit. The pivot portions and the joint portions are in the form of male and female connectors which are engaged with each other such that each of the support leg units is retained relative to the pivot base unit in the longitudinal direction and is only rotatable relative to the pivot base unit about its pivot axis defined by the pivot portions. The support leg units are shiftable, with rotation thereof relative to the pivot base unit, between a folded state, where the lower end portions are close to one another, and an unfolded state, where the lower end portions are remote from one another.

With the inner tubular pieces telescopically extending relative to the outer tubular pieces, the length of the support leg units is reduced when folded so as to facilitate packaging, storage and carrying.

BRIEF DESCRIPTION OF THE DRAWINGS

Other features and advantages of the disclosure will become apparent in the following detailed description of the embodiment with reference to the accompanying drawings. It is noted that various features may not be drawn to scale.

DETAILED DESCRIPTION

Figure 1:
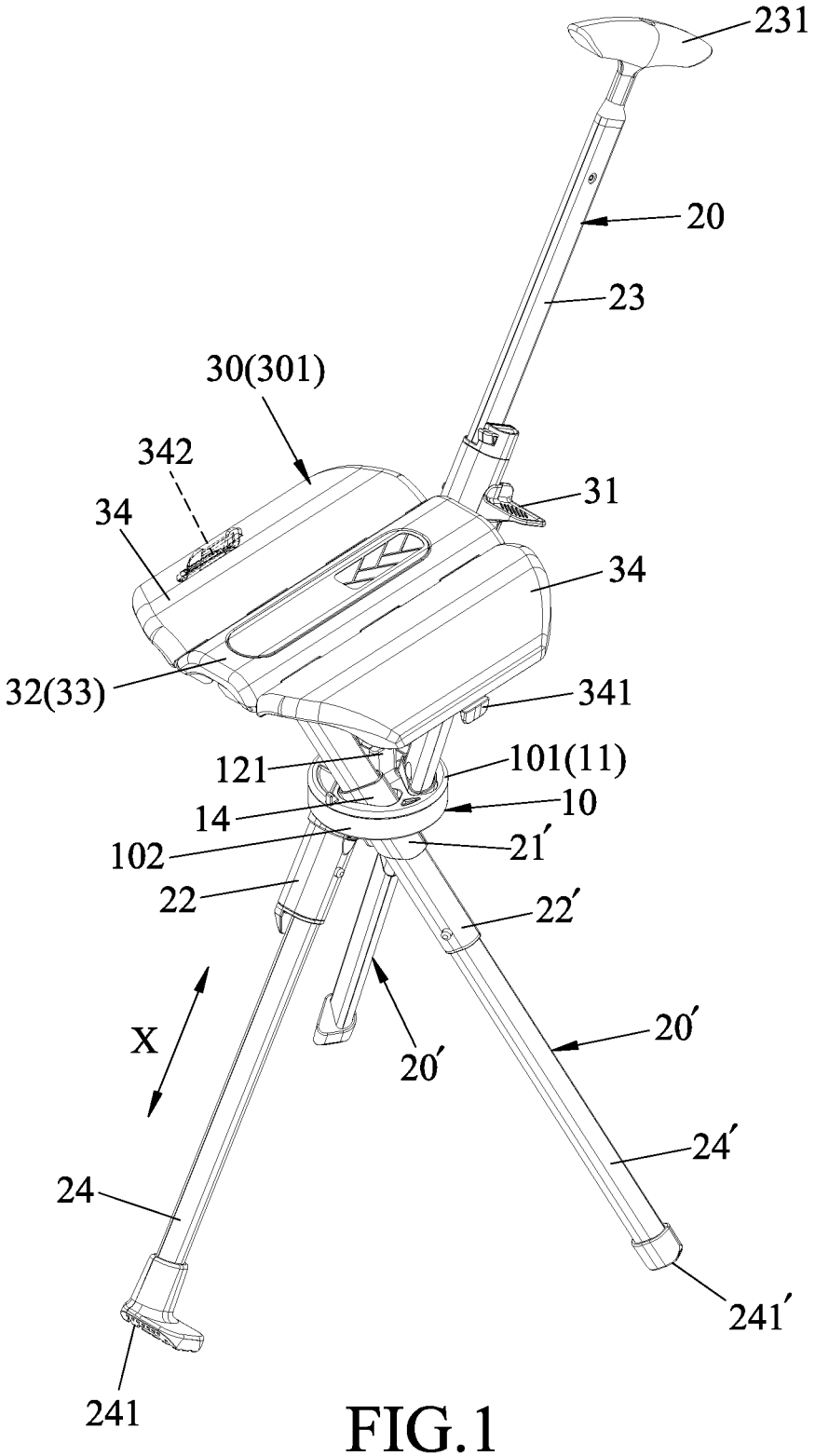
FIG. 1 is a perspective view illustrating an embodiment of a folding crutch chair according to the disclosure in an unfolded state.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 5:
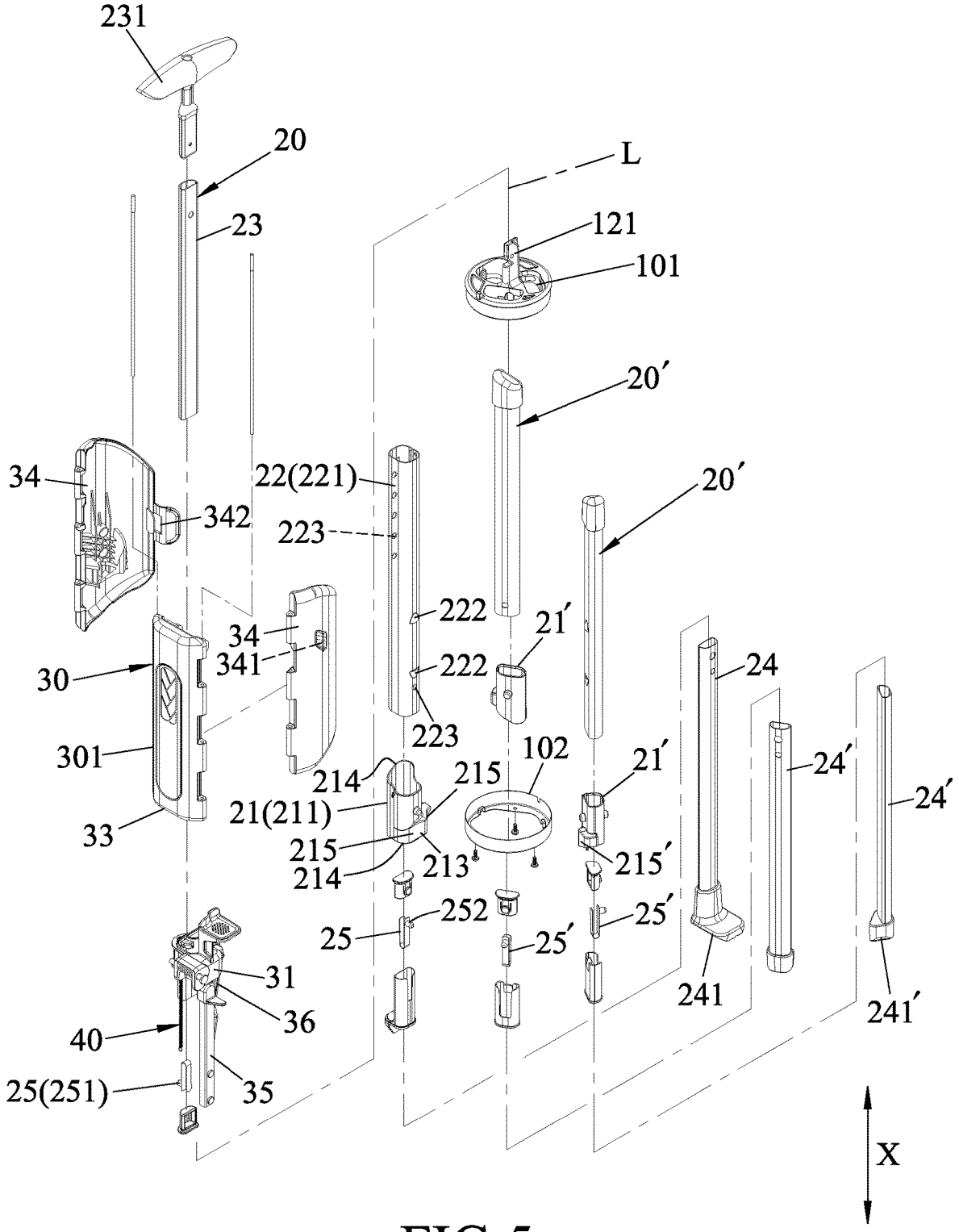
FIG. 5 is an exploded perspective view of the embodiment.
Figure 6:
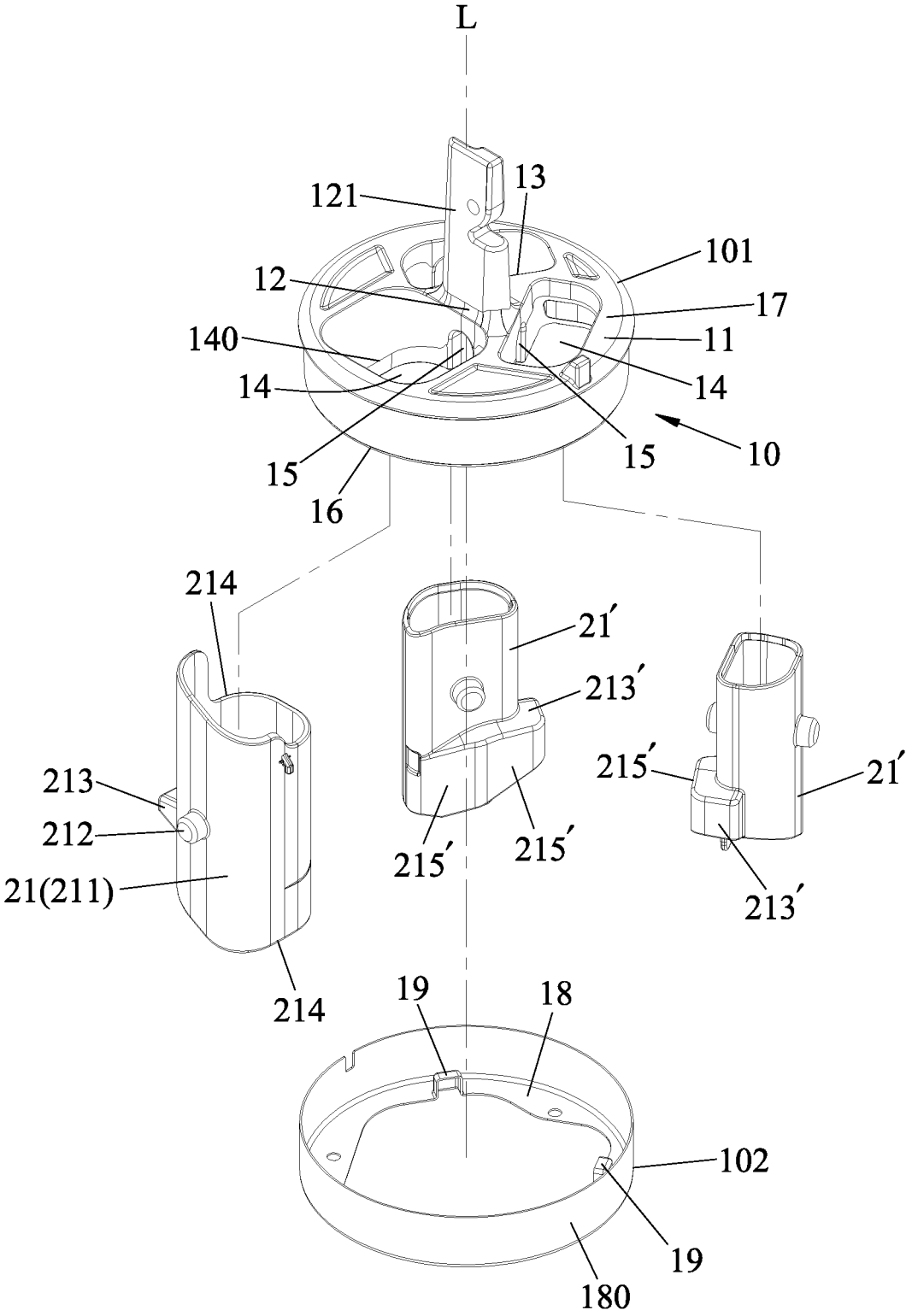
FIG. 6 is an exploded perspective view of a portion of the embodiment.

Referring to FIGS. 1, 5 and 6, an embodiment of a folding crutch chair according to the disclosure includes a pivot base unit 10, three support leg units 20, 20', a seating unit 30 and a tension spring 40.

Figure 9:
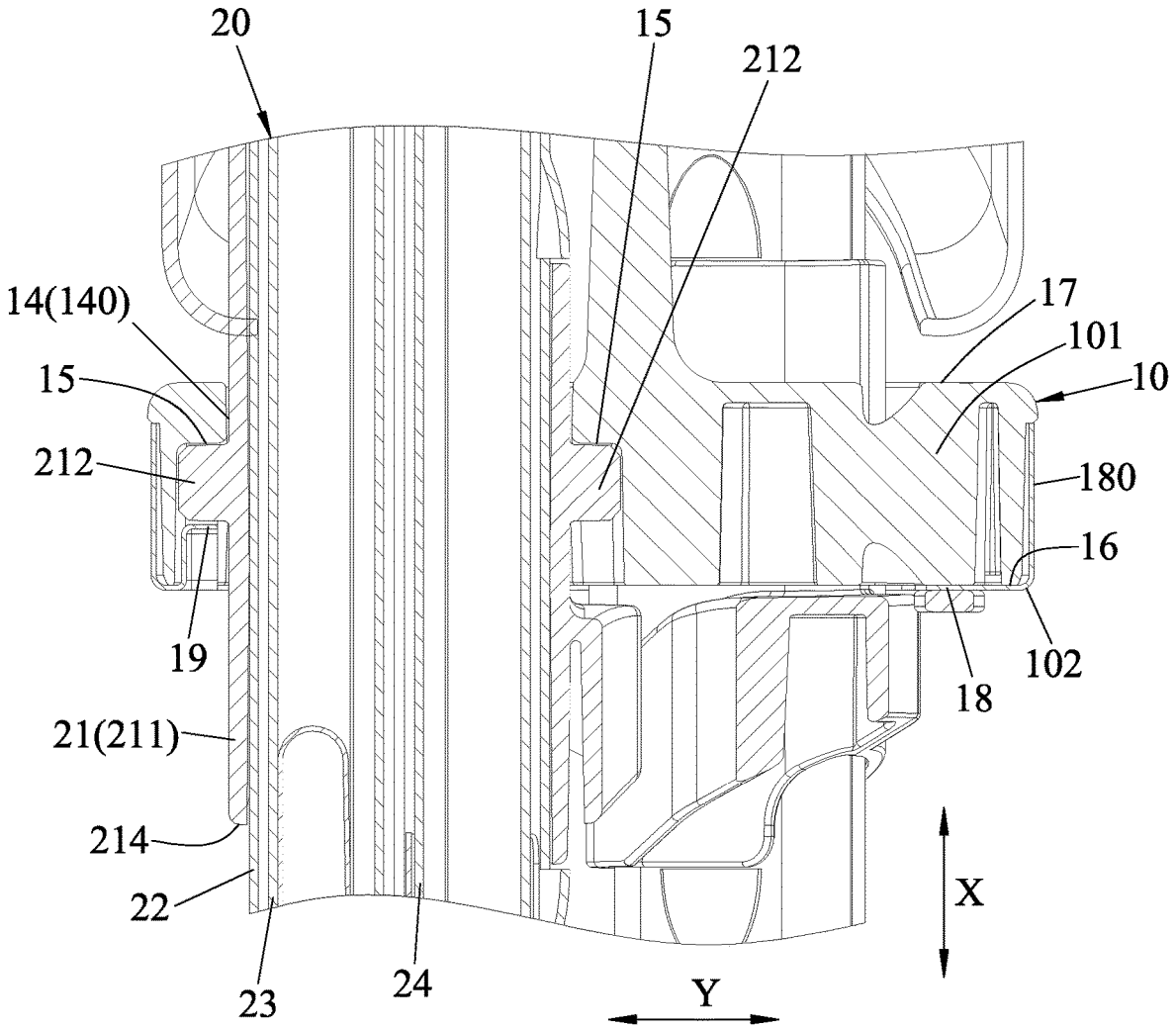
FIG. 9 is a fragmentary, enlarged sectional view illustrating a portion of FIG. 7.
Figure 10:
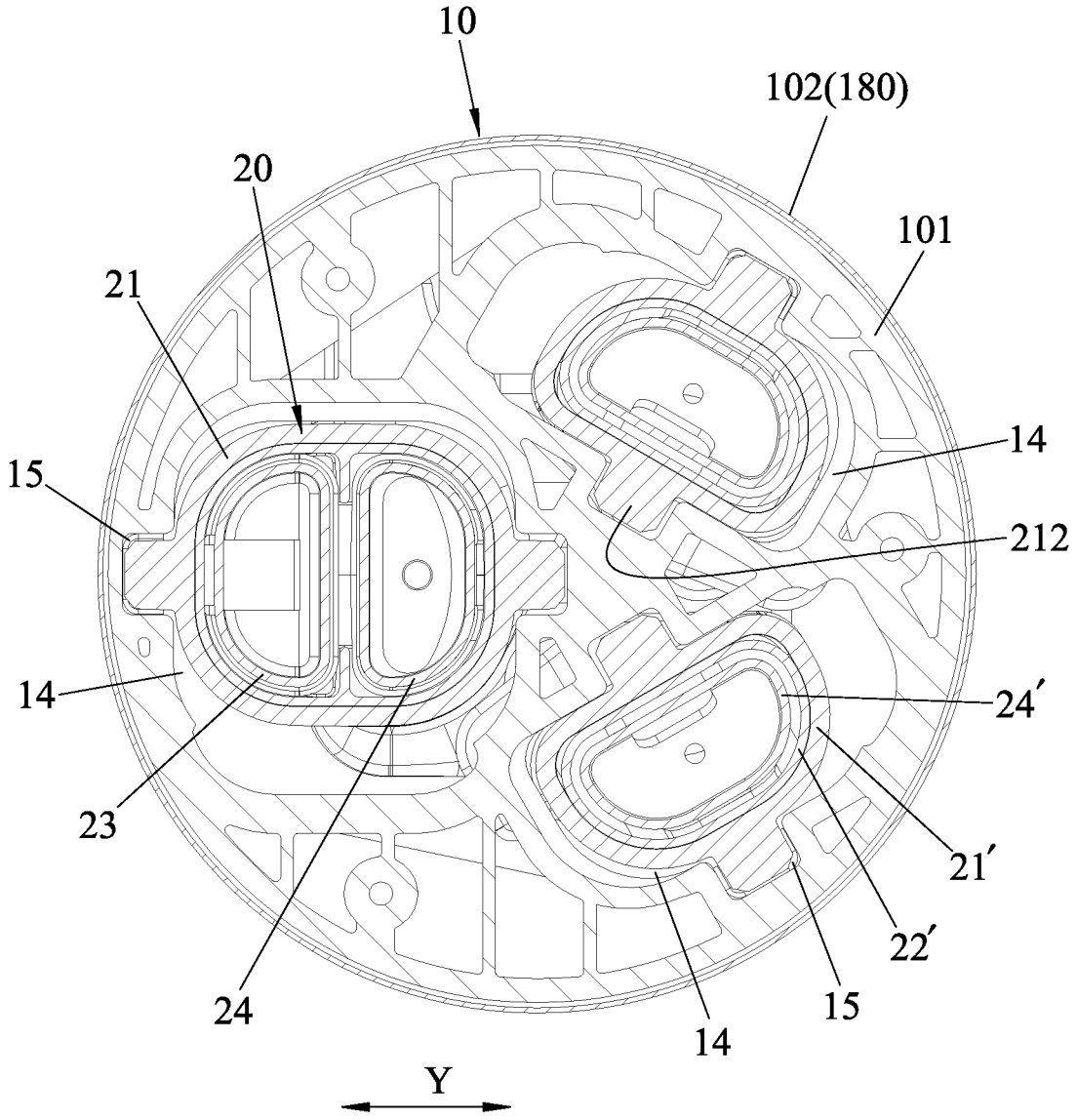
FIG. 10 is a sectional view taken along line X-X of FIG. 7.

With reference to FIG. 9, the pivot base unit 10 includes a base seat 101 and a bottom cover 102 which is securely mounted on the base seat 101. The base seat 101 has a surrounding portion 11 which surrounds an axial line (L), a central portion 12 which is disposed along the axial line (L) and securely fixed within the surrounding portion 11, a plurality of connecting ribs 13 which interconnect the surrounding portion 11 and the central portion 12, a plurality of mounting slots 14 which are angularly spaced apart from one another about the axial line (L), three pairs of joint portions 15 which are respectively formed in the mounting slots 14, a seat bottom end 16, and a seat top end 17 opposite to the seat bottom end 16 along the axial line (L). The central portion 12 has a pivot post 121 extending upwardly from the seat top end 17 along the axial line (L). Specifically, the base seat 101 has three slot walls 140, each extending from the seat top end 17 to the seat bottom end 16 and defining a corresponding mounting slot 14. Each of the joint portions 15 is in the form of a recess which is recessed from a respective slot wall 140 and which extends from the seat bottom end 16 toward the seat top end 17 and in communication with the corresponding mounting slot 14. The joint portions 15 of each pair define a pivot axis that is transverse to the axial line (L).

The bottom cover 102 has a bottom wall 18 which is disposed on and under the seat bottom end 16, a peripheral wall 180 which extends upwardly from a periphery of the bottom wall 18, and three abutment blocks 19 which project upwardly from the bottom wall 18 and which correspondingly extend in the joint portions 15.

One of the support leg unit 20 includes a pivot seat 21 which extends through the corresponding mounting slot 14, an outer tubular piece 22 which is securely disposed on the pivot seat 21 and which extends in a longitudinal direction (X), an upper tubular piece 23 which extends telescopically relative to the outer tubular piece 22 along the longitudinal direction (X), an inner tubular piece 24 which extends telescopically relative to the outer tubular piece 22 along the longitudinal direction (X) and which has a lower end portion 241, and two retaining assemblies 25 which are respectively connected between the outer tubular piece 22 and the upper tubular piece 23, and between the outer tubular piece 22 and the inner tubular piece 24. The upper tubular piece 23 and the inner tubular piece 24 are opposite to each other in a transverse direction (Y) that is transverse to the longitudinal direction (X) (see FIG. 7).

With reference to FIGS. 6, 9, 10 and 11, the pivot seat 21 has a tubular sleeve portion 211 which extends in the longitudinal direction (X) to terminate at upper and lower end edges 214, a pair of pivot portions 212 which are formed on the tubular sleeve portion 211 and which are respectively and pivotably connected with the joint portions 15 of the corresponding pair, and an actuating portion 213 which is securely mounted on the tubular sleeve portion 211. The pivot portions 212 are in the form of pins which extend along the pivot axis and which are engaged with the joint portions 15 formed as recesses. Specifically, the pivot portions 212 and the joint portions 15 are in the form of male and female connectors which are engaged with each other such that the support leg unit 20 is retained relative to the pivot base unit 10 in the longitudinal direction (X) and is only rotatable relative to the pivot base unit 10 about the pivot axis. The abutment blocks 19 of the bottom cover 102 correspondingly extend in the joint portions 15 so as to support and restrain the pivot portions 212 in the joint portions 15 from movement in the longitudinal direction (X). The actuating portion 213 has two thrust surfaces 215 which are formed adjacent to and are arranged to intersect each other at a right angle (see FIG. 11).

Figure 7:
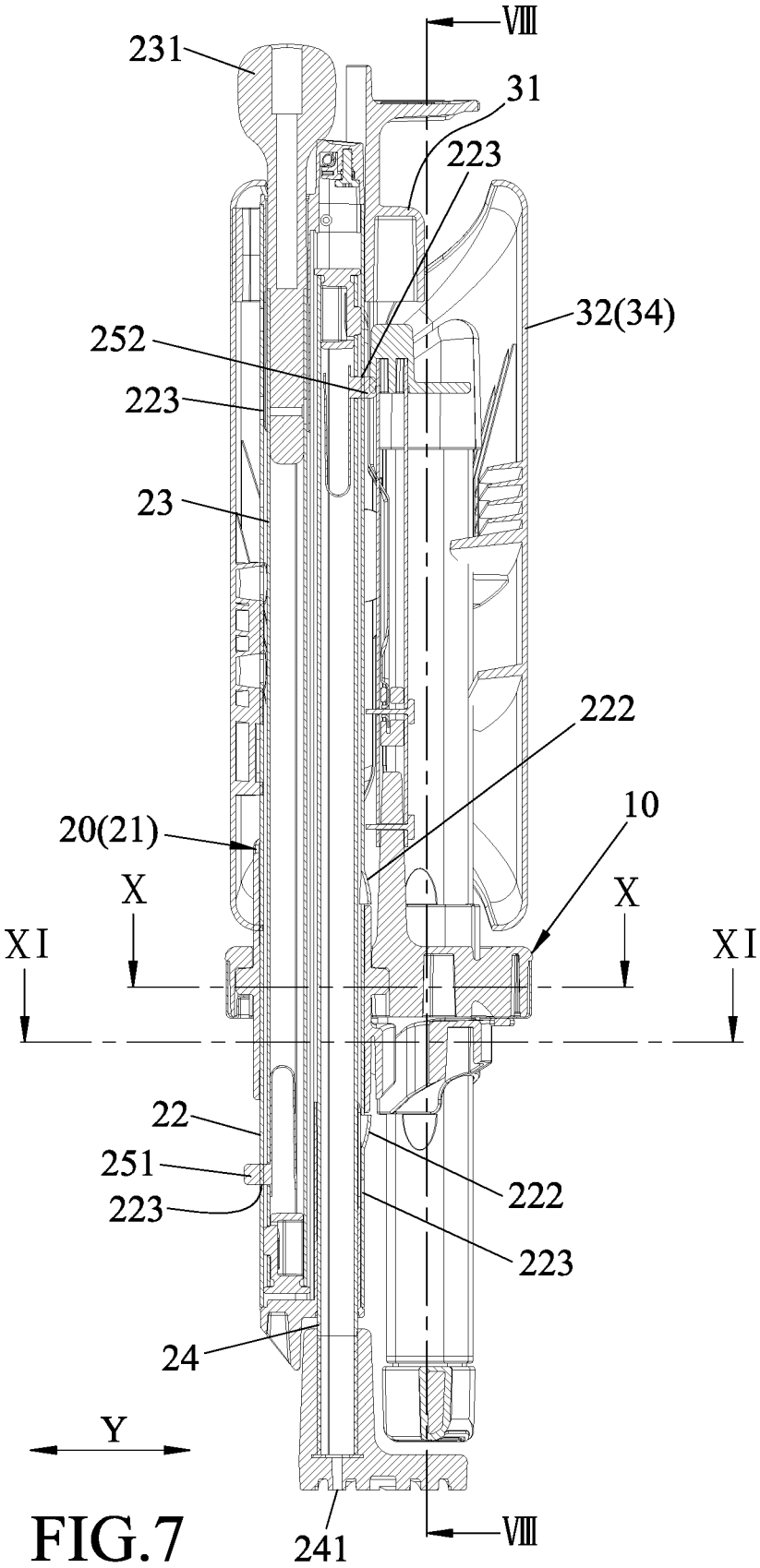
FIG. 7 is sectional view of the embodiment.

With reference to FIG. 5, the outer tubular piece 22 has an outer tubular wall 221 which extends through the tubular sleeve portion 211, and two retaining protrusions 222 which project from the outer tubular wall 221 to respectively abut against upper and lower end edges 214 of the tubular sleeve portion 211 so as to secure the outer tubular piece 22 to the pivot seat 21 (see FIG. 7). The outer tubular piece 22 has a plurality of pin holes 223 formed through the outer tubular wall 221.

The upper tubular piece 23 has a handgrip 231 disposed at an upper portion thereof. One retaining assembly 25 is disposed on a lower portion of the upper tubular piece 23 and has a spring-biased pin 251 which extends radially to be engaged with a selected one of the pin holes 223 formed in the outer tubular piece 22 so as to retain the upper tubular piece 23 to the outer tubular piece 22. The other retaining assembly 25 is disposed on an upper portion of the inner tubular piece 24 opposite to the lower end portion 241, and has a spring biased pin 252 which extends radially to be engaged with a selected one of the pin holes 223 formed in the outer tubular piece 22 so as to retain the inner tubular piece 24 in the outer tubular piece 22.

With reference to FIGS. 8 to 11, each of the other two support leg units (20') also includes a pivot seat (21') which extends through a corresponding mounting slot 14 and which is pivotably connected with the pivot base unit 10, an outer tubular piece (22') which is securely disposed on the pivot seat (21') and which extends along a longitudinal direction (X), an inner tubular piece (24') which extends telescopically relative to the outer tubular piece (22') along the longitudinal direction (X) and which has a lower end portion (241'), and a retaining assembly (25') which is connected between the outer tubular piece (22') and the inner tubular piece (24') to retain the inner tubular piece (24') to the outer tubular piece (22') when the inner tubular piece (24') is extended from the outer tubular piece (22'). The pivot seat (21'), the outer tubular piece (22'), the inner tubular piece (24') and the retaining assembly (25') are similar to those of the support leg unit 20. The actuating portion (213') of the pivot seat (21') also has two thrust surfaces (215') that are formed adjacent to and inclined relative to each other.

The seating unit 30 includes a seating assembly 301 which is connected with an upper portion of the outer tubular piece 22 of the support leg unit 20, and a linkage assembly 302 which is pivotally connected between the seating member 301 and the pivot post 121 of the pivot base unit 10 and which is moved with the seating assembly 301. The seating assembly 301 has a sliding bracket 31 which is slidably sleeved on the outer tubular piece 31 in the longitudinal direction (X), and a seating member 32 which is pivotably connected with the sliding bracket 31 and supported by the other two support leg units (20'). Specifically, the seating member 32 has a central plate portion 33 which is pivotably connected with the sliding bracket 31, and a pair of lateral plate portions 34 which are adjoined with the central plate portion 33 and respectively supported by the upper portions of the support leg units (20'). The distal end edges of the lateral plate portions 34 respectively have male and female fasteners 341, 342 to be snap connected with each other. The linkage assembly 302 has a first linking bar 35 which is pivotably connected with the pivot post 121 at one end and which is slidable on a bottom surface of the central plate portion 33 at an opposite end, and a second linking bar 36 which is pivotably connected between the first linking bar 35 and the sliding bracket 31.

The tension spring 40 has an end connected with the sliding bracket 31, and an opposite end connected with the pivot seat 21 to bias the sliding bracket 31 toward the pivot base unit 10. Alternatively, the lower end of the tension spring 50 may be connected with the pivot base unit 10.

Referring again to FIGS. 1 and 2, when the support leg units (20, 20') are in an unfolded state, the seating member 32 is spread in a seated position, where a seating surface thereof is remote from and extends transverse to the support leg unit 20. In this state, the lower end portions (241, 241') of the support leg units (20, 20') are remote from one another, upper end portions of the support leg units (20') are remote from each other and are engaged with the lateral plate portions 34 to support the lateral plate portions 34, the first linking bar 35 supports the central plate portion 33, and a proximal end of the central plate portion 33 is pivotably connected with the sliding bracket 31.

When a user operates the sliding bracket 31 to move it upwardly along the outer tubular piece 22, through the movement of the linkage assembly 302 with the sliding bracket 31, the seating member 32 is moved with the linkage assembly 302 and shifted to a collapsed position, where the seating surface of the seating member 32 is close to and extends parallel to the support leg unit 20. At this time, the support leg unit 20 which is connected with the linkage assembly 302 is pivoted relative to the pivot base unit 10, and the support leg units (20, 20') are shifted from the unfolded state to a folded state (see FIG. 3), where the lower end portions (241, 241') of the support leg units (20, 20') are close to one another. The seating member 32 is close to the sliding bracket 31 (as shown in FIG. 7) in the collapsed position. At this stage, the sliding bracket 31 is moved away from the pivot seat 21 so that the tension spring 50 is tensed.

Figure 4:
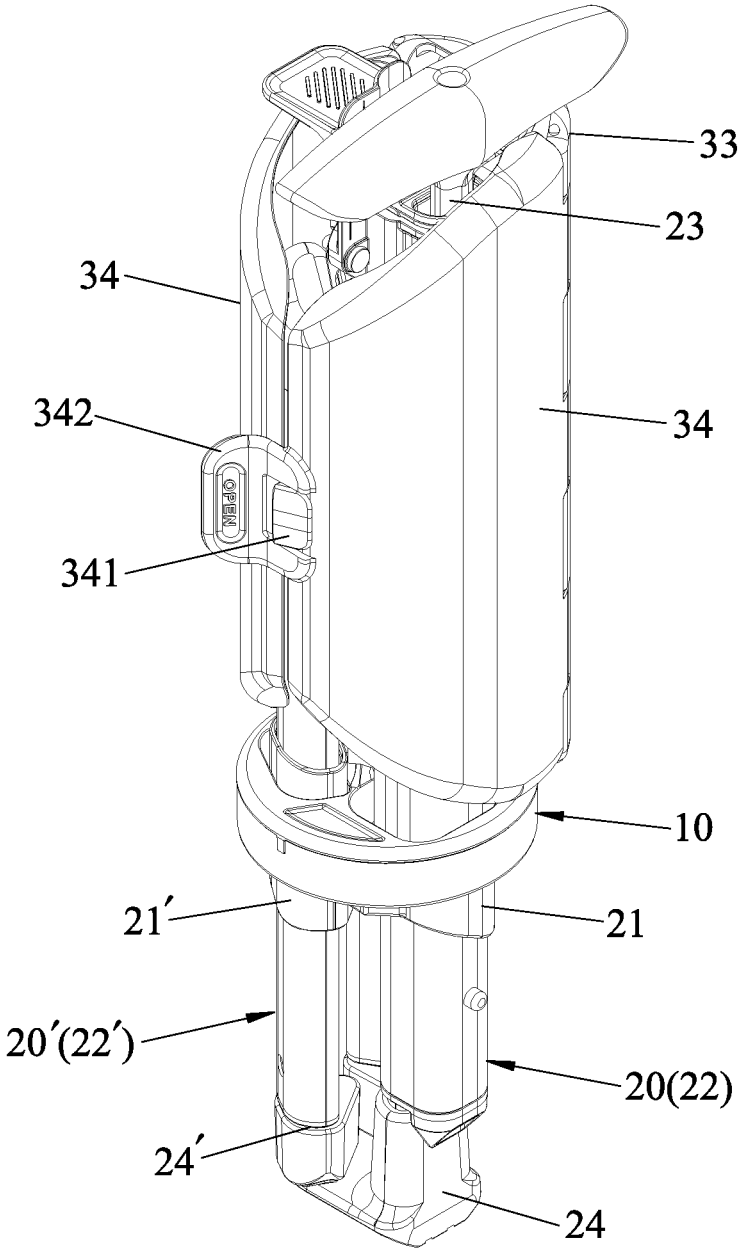
FIG. 4 is a perspective view of the embodiment in a fully folded state.
Figure 8:
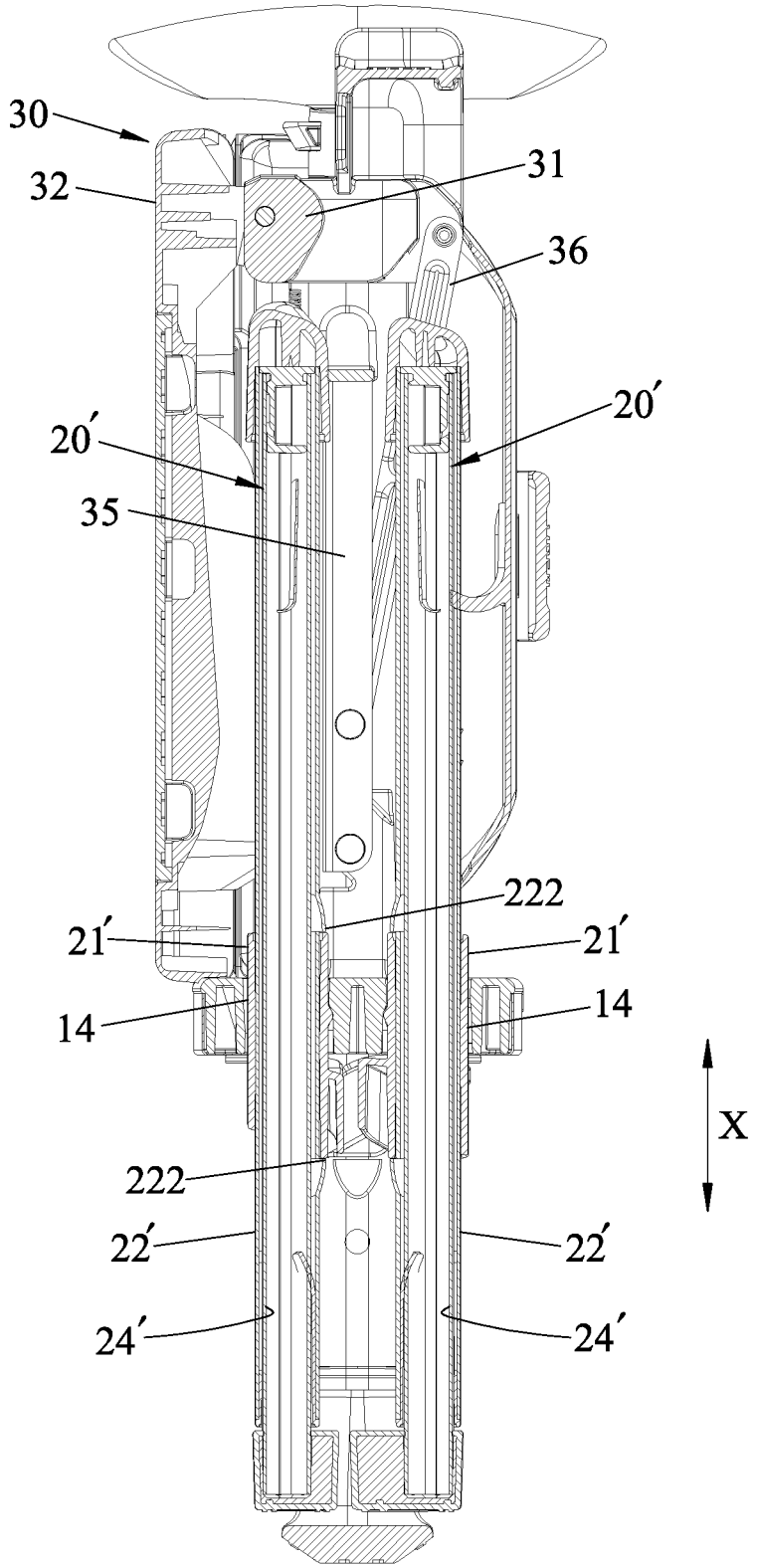
FIG. 8 is a sectional view taken along line VIII-VIII of FIG. 7.

Next, the upper tubular piece 23 of the support leg unit 20 is retracted into the outer tubular piece 22, and the inner tubular piece 24 is retracted into the outer tubular piece 22. The upper and inner tubular pieces 23, 24 are retained to the outer tubular piece 22 by the retaining assemblies 25. Also, the inner tubular piece (24') of each support leg unit (20') is retracted into the outer tubular piece (22') and is retained to the outer tubular piece (22') by the retaining assembly (25'), as shown in FIGS. 7 and 8, so as to render the folding crutch chair compact (referring to FIG. 4).

Figure 3:
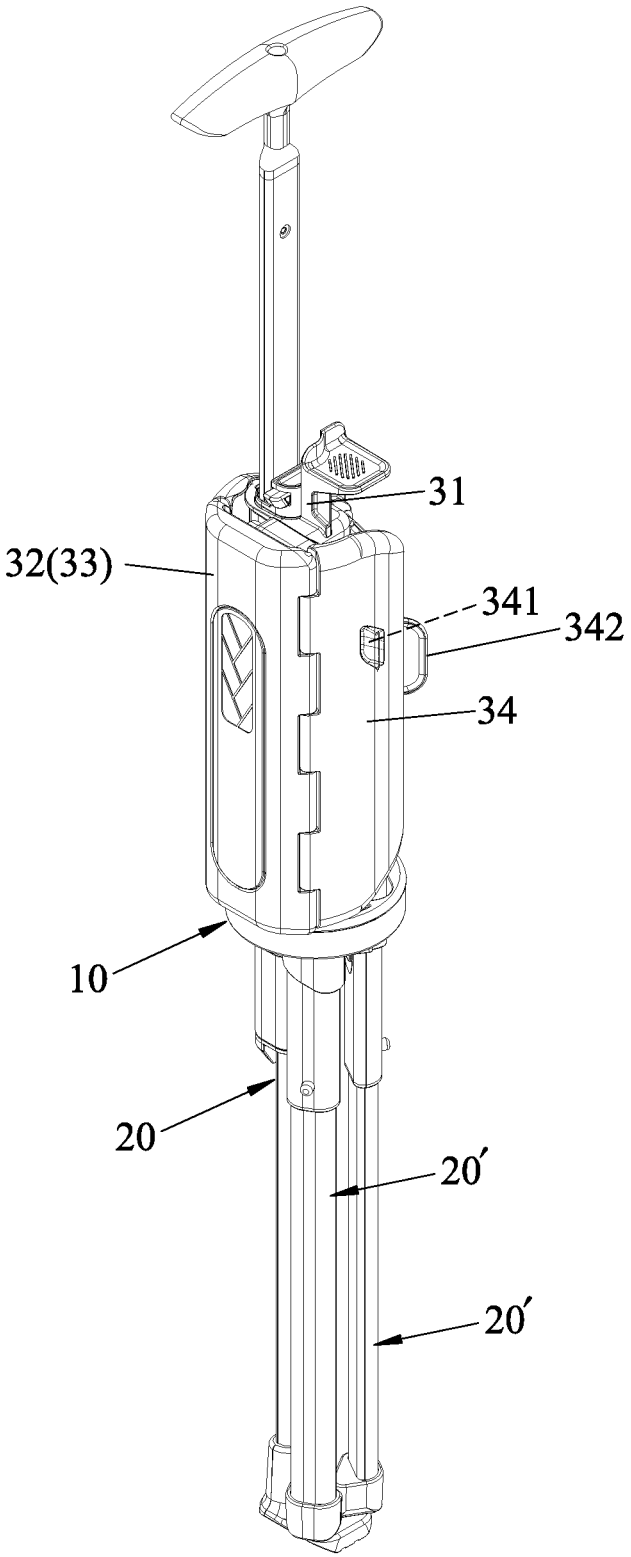
FIG. 3 is a perspective view of the embodiment in a folded state.

Referring to FIG. 3, when the support leg units (20, 20') are in the folded state, the seating member 32 is in the collapsed position, the lateral plate portions 34 and the central plate portion 33 cooperatively define a hollow cylinder to surround the support leg units (20, 20'). Then, the male and female fasteners 341, 342 of the lateral plate portions 34 are snap connected with each other.

Figure 2:
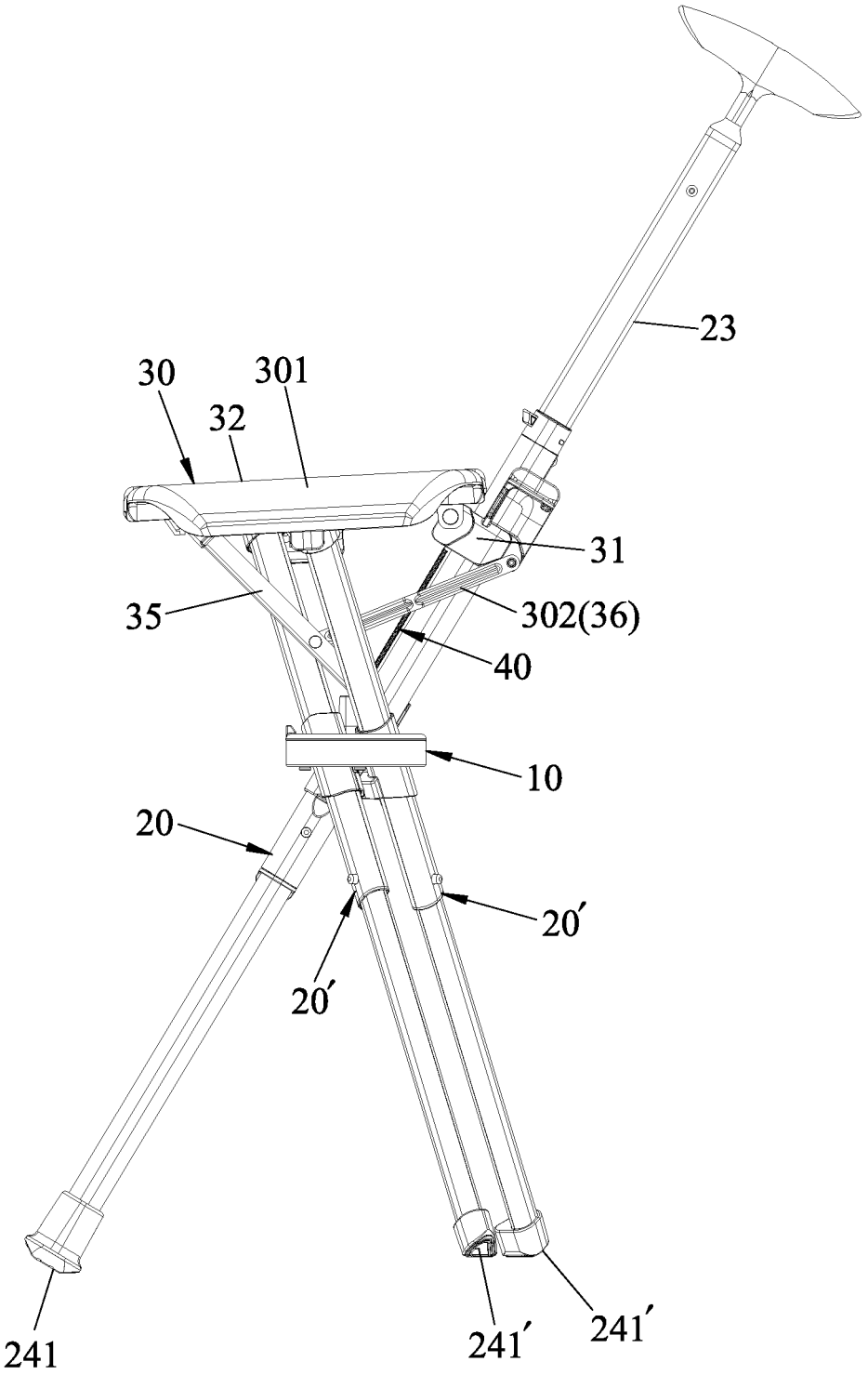
FIG. 2 is a side view of the embodiment in the unfolded state.
Figure 11:
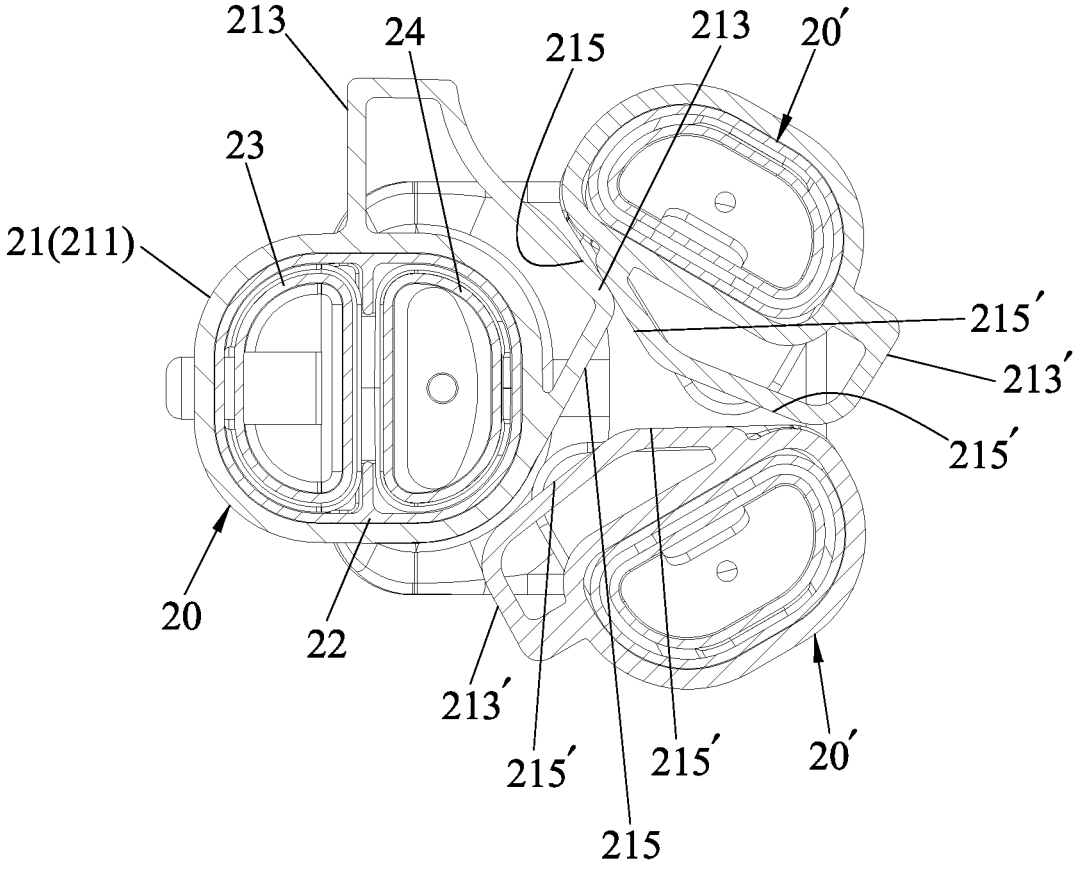
FIG. 11 is a sectional view taken along line XI-XI of FIG. 7.
Figure 12:
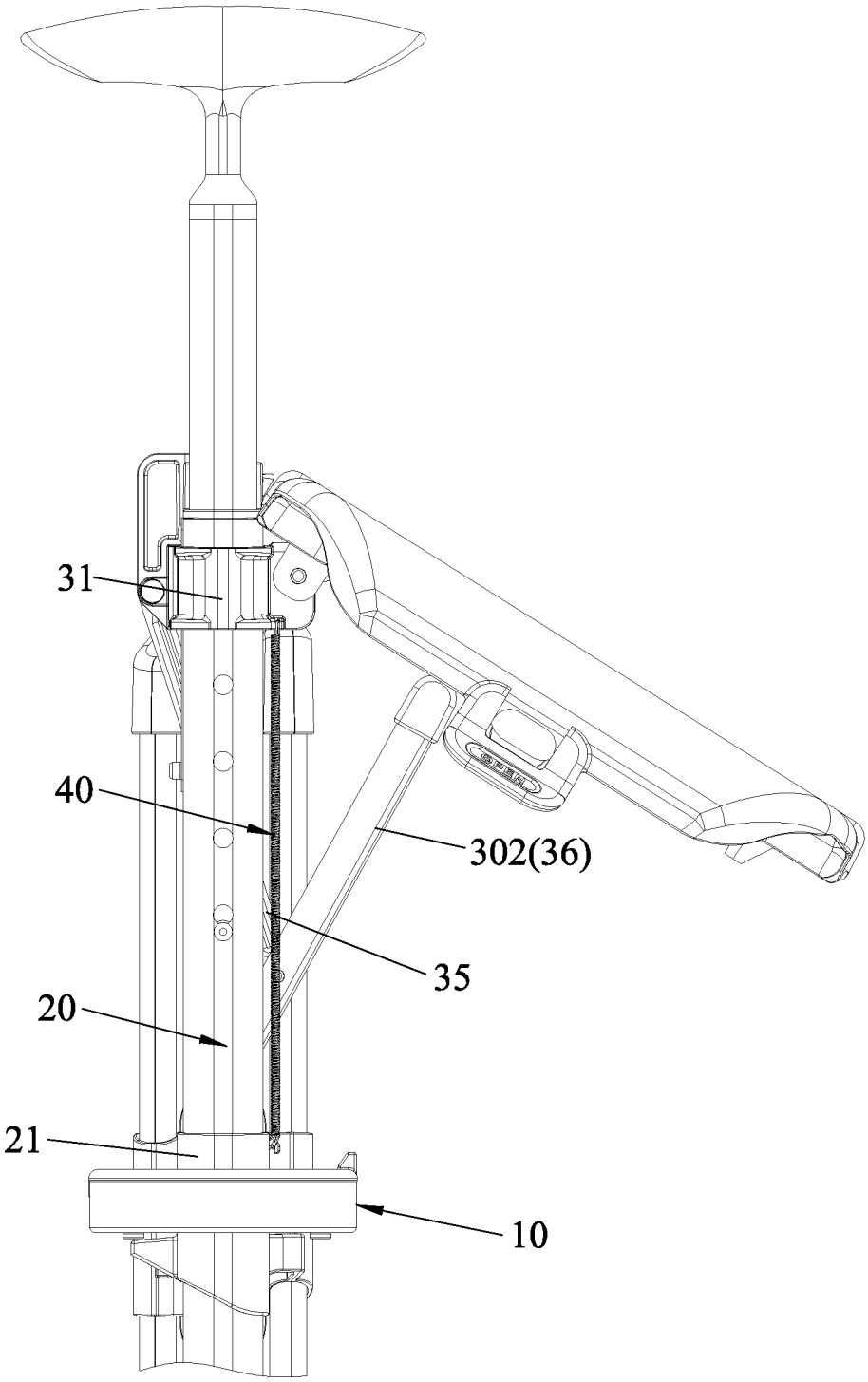
FIG. 12 is a fragmentary side view illustrating the embodiment operated to shift to the unfolded state.
Figure 13:
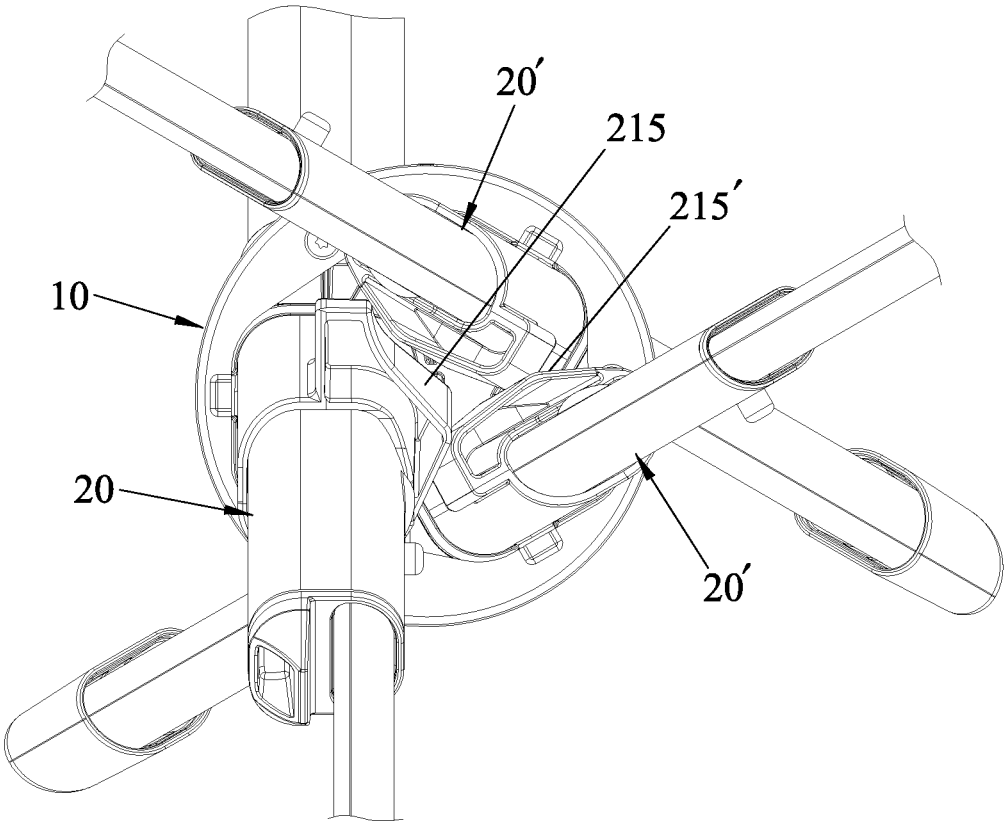
FIG. 13 is a fragmentary perspective view illustrating the embodiment in the unfolded state.

Referring to FIGS. 11 to 13, when the user operates the sliding bracket 31 to move it downwardly along the support leg unit 20, the sliding bracket 31 is moved smoothly toward the pivot base unit 10 with the biasing action of the tension spring 50. Through the transmitting movement of the second linking bar 36 and the first linking bar 35 of the linkage assembly 302, the support leg unit 20 is pivoted relative to the pivot base unit 10, and the thrust surfaces 215 of the support leg unit 20 respectively thrust the thrust surfaces (215') of the two adjacent actuating portions (213') to make synchronous pivot of the support leg units (20') relative to the pivot base unit 10 so as to shift the support leg units (20, 20') to the unfolded state to move the lower end portions (241, 241') remote from one another (back to the state as shown in FIGS. 1 and 2).

Referring to FIGS. 7 to 10, with the pivot portions 212 of the support leg units (20, 20') pivotably connected with the joint portions 15 of the pivot base unit 10, the outer tubular piece (22, 22') has a sufficient space therein for telescopically receiving the upper tubular piece 23 and the inner tubular piece (24, 24') so that the inner tubular piece (24, 24') is extended from and retracted into the outer tubular piece (22, 22') to reduce the length of the support leg units (20, 20') when folded to render the size of the folding crutch chair compact.

Furthermore, in this embodiment, the pivot portions 212 are in the form of pins, and the joint portions 15 are in the form of recesses. Alternatively, the pivot portions 212 may be in the form of recesses and the joint portions 15 may be in the form of pins.

As illustrated, the folding crutch chair of the disclosure is shiftable between the unfolded state to be used as a chair, and the folded state to render the size compact and reduce the length thereof for easier packaging, storage and carrying.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A folding crutch chair comprising:

a pivot base unit having at least three mounting slots which are angularly spaced apart from one another about an axial line, and at least three pairs of joint portions which are respectively formed in said mounting slots; and at least three support leg units, each of said support leg units including a pivot seat which extends through a respective one of said mounting slots and which is pivotably connected with said pivot base unit, an outer tubular piece which is securely disposed on said pivot seat and which extends along a longitudinal direction, an inner tubular piece which extends telescopically relative to said outer tubular piece along the longitudinal direction and which has a lower end portion, and a retaining assembly which is connected between said outer tubular piece and said inner tubular piece to retain said inner tubular piece to said outer tubular piece when said inner tubular piece is extended from said outer tubular piece, said pivot seat of each of said support leg units having a pair of pivot portions which are respectively and pivotably connected with said joint portions of a corresponding pair of said pivot base unit, said pivot portions and said joint portions being in form of male and female connectors which are engaged with each other such that each of said support leg units is retained relative to said pivot base unit in the longitudinal direction and is only rotatable relative to said pivot base unit about its pivot axis defined by said pivot portions, said support leg units being shiftable, with rotation thereof relative to said pivot base unit, between a folded state, where said lower end portions are close to one another, and an unfolded state, where said lower end portions are remote from one another.

2. The folding crutch chair of claim 1, wherein each of said joint portions of said pivot base unit is in form of a recess in communication with a corresponding one of said mounting slots, and each of said pivot portions of said pivot seat is in form of a pin which extends along the pivot axis and which is engaged with said recess.

3. The folding crutch chair of claim 2, wherein said pivot base unit includes a base seat and a bottom cover which is securely mounted on said base seat, said base seat having a seat bottom end which faces said lower end portions, and a seat top end opposite to said seat bottom end, said base seat having at least three slot walls, each extending from said seat top end to said seat bottom end and defining a respective one of said mounting slots, each of said joint portions being recessed from a respective one of said slot walls and extending from said seat bottom end toward said seat top end, said bottom cover having a bottom wall which is disposed on said seat bottom end, and at least three abutment blocks which project upwardly from said bottom wall and which correspondingly extend in said joint portions to support and position said pivot portions in said corresponding joint portions.

4. The folding crutch chair of claim 1, wherein said pivot seat of each of said support leg units has a tubular sleeve portion which extends in the longitudinal direction to terminate at upper and lower end edges, said outer tubular pieces having an outer tubular wall which extends through said sleeve portion, and two retaining protrusions which project from said outer tubular wall to respectively abut against upper and lower end edges so as to secure said outer tubular piece to said pivot seat.

5. The folding crutch chair of claim 1, wherein one of said support leg units further has an upper tubular piece which extends telescopically relative to said outer tubular piece along the longitudinal direction, said upper tubular piece and said inner tubular piece being opposite to each other in a transverse direction that is transverse to the longitudinal direction.

6. The folding crutch chair of claim 1, wherein said pivot seat of each of said support leg units has a tubular sleeve portion which extends in the longitudinal direction, and an actuating portion which is securely mounted on said tubular sleeve portion and which has two thrust surfaces that are formed adjacent to and inclined relative to each other, said actuating portions being angularly spaced apart from one another about the axial line, said thrust surfaces of one of said actuating portions being arranged to intersect each other at a right angle, and to be close to and engage with said thrust surfaces of two adjacent ones of said actuating portions, respectively, when said support leg units are in the folded state, wherein, when said pivot portions of one of said support leg units are pivoted relative to said joint portions, said thrust surfaces of said one actuating portion respectively thrust said thrust surfaces of said two adjacent actuating portions to make synchronous pivot of said support leg units relative to said pivot base unit so as to shift said support leg units to the unfolded state and move said lower end portions to be remote from one another.

7. The folding crutch chair of claim 1, further comprising a seating unit, said seating unit being supported by said support leg units when the support leg units are in the unfolded state.

8. The folding crutch chair of claim 7, wherein said seating unit includes a seating assembly which is connected with one of said support leg units, and a linkage assembly which is pivotally connected between said seating member and said pivot base unit and which is moved with said seating assembly, wherein, through the movement of said linkage assembly with said seating assembly, said one support leg unit is pivoted relative to said pivot base unit, and said support leg units are shifted between the folded state and the unfolded state.

9. The folding crutch chair of claim 8, wherein said seating assembly has a sliding bracket which is slidably sleeved on said one support leg unit in the longitudinal direction, and a seating member which is connected with said sliding bracket and supported by other ones of said support leg units, said linkage assembly being pivotably connected between said sliding bracket and said pivot base unit, wherein, through the pivoting of said one support leg unit relative to said pivot base unit, and as a result of the movement of said linkage assembly when said sliding bracket is slided toward said pivot base unit, said support leg units are shifted from the folded state to the unfolded state, and said seating member is shifted from a collapsed position, where a seating surface of said seating member is close to said pivot base unit, to the seated position, where said seating surface is remote from said pivot base unit and is kept transverse to said one support leg unit to be seated thereon.

10. The folding crutch chair of claim 9, further comprising a tension spring which has an end connected with said sliding bracket, and an opposite end connected with one of said pivot base unit and said one support leg unit to bias said sliding bracket toward said pivot base unit.

* * * * *